United States Patent [19]

Gagnon et al.

[11] Patent Number: 4,829,573

[45] Date of Patent: May 9, 1989

[54] SPEECH SYNTHESIZER

[75] Inventors: Richard T. Gagnon, Milford; Duane W. Houck, Highland, both of Mich.

[73] Assignee: Votrax International, Inc., Troy, Mich.

[21] Appl. No.: 938,149

[22] Filed: Dec. 4, 1986

[51] Int. Cl.[4] ..... G10L 5/00

[52] U.S. Cl. ..... 381/41; 381/36; 381/40; 381/51; 381/53; 364/513.5

[58] Field of Search ..... 381/37, 36, 29, 49, 381/41, 51, 53, 40, 42, 50; 364/513.5

[56] References Cited

U.S. PATENT DOCUMENTS

| | | | |
|---|---|---|---|
| 4,264,783 | 4/1981 | Gagnon | 381/53 |
| 4,360,708 | 11/1982 | Taguchi et al. | 381/36 |
| 4,392,018 | 7/1983 | Fette | 381/51 |
| 4,507,750 | 3/1985 | Frantz et al. | 381/41 |

*Primary Examiner*—William M. Shoop, Jr.
*Assistant Examiner*—Brian K. Young
*Attorney, Agent, or Firm*—Brooks & Kushman

[57] ABSTRACT

A phonetically-driven speech synthesizer and method substantially entirely embodied in a programmed microprocessor. Information indicative of control parameters for each of a plurality of phonemes is stored in a phoneme parameter matrix and selectable by phoneme code. Time-invariant programming controls operation during successive operating cycles of equal time duration to obtain parameter information in a predetermined sequence for each selected phoneme, update control signals as a function of such parameter information, and operate a lattice filter vocal tract as a function of updated control signals to generate phonetic sounds. Separate sources of vocal and fricative sounds comprise corresponding look-up tables which are accessed are required during each operating cycle.

26 Claims, 15 Drawing Sheets

SPEECH SPEED RATE CONTROL (LINES 108-117) (TO 40, 46, 54, 56, 68 AND 70 IN FIG. 2)

PHONEME BUFFER CONTROL (LINES 118-132, 190-197, 163-164) (24 AND 42 IN FIG. 2)

SPEECH SYNTHESIZER

Reference is made to a microfiche appendix which accompanies this application, consisting of one sheet of microfiche containing twenty-four frames.

The present invention relates to human speech synthesis, and more particularly to an apparatus and method for phonetically-driven speech synthesis.

BACKGROUND AND OBJECT OF THE INVENTION

Phonetically-driven electronic speech synthesizers conventionally include a filter network or model which simulates the characteristics of the human vocal tract. The vocal tract filter network or model receives input signals indicative of vocal and/or fricative sounds in the phoneme to be synthesized, and provides an output to an appropriate speaker or the like. Each available phoneme has associated therewith a number of parameters for effectively controlling poles of the vocal tract filter network or model, as well as controlling amplitude and timing characteristics of input and output signals to or from the vocal tract. To synthesize words or phrases, necessary phoneme parameter signals are fed in turn to the synthesizer electronics.

U.S. Pat. No. 3,836,717 discloses a phonetically-driven speech synthesizer in which a multiplicity of phoneme speech parameters are stored in a read-only-memory matrix addressable by a six-bit phoneme input code. The selected parameters for each phoneme are fed through resistor ladder networks for conversion to analog signals, and then fed through lowpass filter networks to simulate dynamic sluggishness of a human vocal tract. Vocal and fricative sounds from separate sound generators are combined and directed to a vocal tract which includes a series of tuned frequency domain resonant filters for combined amplitude and frequency control as a function of the filtered phoneme parameters. The remaining two bits of the eight-bit input code control pitch of synthesized vocal sounds. Among the phoneme parameters stored in the ROM matrix are the constants which define the poles of the resonant filter vocal tract, and parameters which operate on vocal and fricative sounds to simulate interaction of successive phonemes.

U.S. Pat. No. 3,908,085 discloses an improvement in the synthesizer disclosed in the aforementioned patent in which the vocal tract comprises series-connected tunable filters which receive duty-cycle control signals as a function of phoneme parameters. U.S. Pat. No. 4,209,844 discloses a speech synthesizer in which a digital time-domain lattice filter network is alternately connected to a vocal or a fricative sound source for receiving digital data indicative of sounds to be uttered. The digital lattice filter network, which is implemented in a custom integrated circuit, performs a series of multiplications and summations on input data under control of filter pole-indicating coefficients which vary between the decimal equivalent of minus 1 and plus 1. Other prior art patents of background interest are U.S. Pat. Nos. 4,128,737, 4,130,730, 4,264,783 and 4,433,210.

Although speech synthesizers of various constructions have been developed and marketed in accordance with one or more of the above-noted patents, a number of deficiencies remain. For example, speech synthesizers heretofore proposed are generally characterized by substantial bulk and expense, severely limiting the scope of commercial applications. Furthermore, devices heretofore proposed do not simulate human speech as closely as desired in terms of certain types of phonetic sounds—i.e., combined voice/fricative sounds—and certain types of sound transitions between adjacent interacting phonemes. A general object of the present invention is to provide a speech synthesizer and method of operation which are compact and versatile in design and implementation, which are economical to fabricate and market, which are readily amenable to programming for articulation of differing phoneme strings, and which generate phonetic sounds which closely simulate human speech. A further object of the invention is to provide a speech synthesizer and method of the described character in which parameters such as pitch and speed rate may be varied at will by an operator.

SUMMARY OF THE INVENTION

In accordance with the present invention, a phonetically-driven speech synthesizer includes a time domain lattice filter vocal tract network which receives inputs indicative of vocal and/or fricative components of a phoneme. The fricative phoneme component, if any, is generated by differential noise, while the vocal phoneme component, if any, has an amplitude which varies with time as a function of a partially integrated chirp-pulse. Both the differential noise fricative sound source and the partially integrated chirp-pulse vocal sound source closely approximate the frequency content of human speech. A storage matrix contains a multiplicity of parameters stored in a table as a function of operator-selectable phoneme codes. These parameters, for each phoneme, designate poles of the vocal tract lattice filter network, and control timing and amplitude of vocal and fricative sounds, both within a phoneme and at the interface between successive phonetic sounds.

In the preferred embodiment of the invention, the foregoing is implemented through software and/or firmware in a microprocessor-based digital computer. Memory, preferably in the form of a read-only-memory, contains the phoneme parameter matrix selectable by digital phoneme code, look-up tables containing the differential noise fricative source waveform and the partially integrated chirp-pulse vocal source waveform, and an operating system in the form of executable code. A buffer memory receives and stores digital bytes from a phoneme source indicative of sequence of phonemes to be synthesized. Each such phoneme byte includes six bits for identification of phoneme by code, and two bits for control of phoneme pitch. Each byte in the phoneme buffer is read in turn, and the corresponding phonetic sound generated at the vocal tract under control of the corresponding phoneme parameters stored in the phoneme matrix.

In accordance with an important feature or aspect of the invention, the synthesizer operating system programming for outputting each phoneme in turn take the form of so-called time-invarient programming. That is, each phonetic sound is generated over a corresponding time interval (selected by the matrix parameters) in a multiplicity of fields or operating cycles of predetermined equal time duration. Each field includes a series of operations for implementing one of the phoneme parameters, followed by execution of a vocal/fricative input routine, a vocal tract routine and an output routine for updating or refreshing the output sound. The output sound is thus automatically refreshed at predetermined periodic sampling intervals of equal time duration. In the preferred embodiment of the invention, such sampling frequency is about 8 KHz, which closely matches characteristics of human speech.

In order to achieve such time-invarient output sampling frequency, it is necessary that all of the input, vocal tract and output routines be more efficient than heretofore realizable in the art. In the vocal tract routine, for example, the so-called forward wave lattice filter variables are computed based upon the so-called back wave variables computed during the preceding sampling interval. Furthermore, multiplications are performed using a multiplication look-up table stored in ROM rather than mathematically, which not only saves time but also reduces mathematical noise. Moreover, the lattice filter pole constants are set at $\frac{1}{8}$ increments between values of plus one and minus one which, in combination with eight bit processing, permits multiplication to be performed by shifting bits of the operands. The result is a vocal tract routine which is not only fast and efficient, but which also possesses significantly enhanced signal-to-noise ratio as compared with vocal tract routines of the prior art.

Each six-bit phoneme code selects one of sixty-three selectable phonemes, or a "break" phoneme. In processing the "break" phoneme the two-bit pitch control code is read for updating global pitch or speech speed inputs, or for terminating operation. Thus, speech speed and global pitch may be altered "on the fly" as appropriate, and without interrupting normal operation.

BRIEF DESCRIPTION OF THE DRAWINGS.

The invention, together with additional objects, features and advantages thereof, will be best understood from the following description, the appended claims and the accompanying drawings in which:

DETAILED DESCRIPTION OF THE PREFERRED EMBODIMENTS

Figure 1:
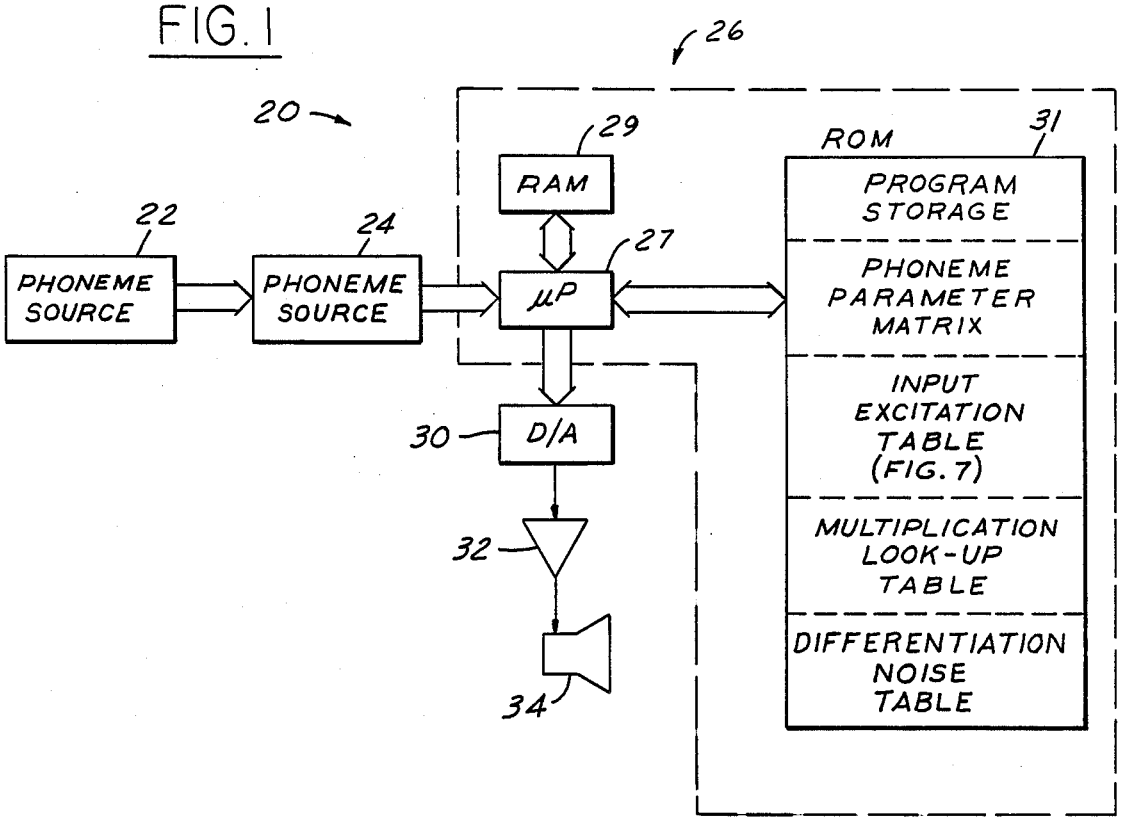
FIG. 1 is a general functional block diagram of phonetic speech synthesizer hardware in accordance with a presently preferred embodiment of the invention.

FIG. 1 illustrates a speech synthesizer 20 in accordance with a presently preferred embodiment of the invention as comprising a phoneme source 22 which feeds a series of phoneme selection codes to a phoneme input buffer in which the codes are stored. The stored phoneme codes are fed in sequence and on demand to phoneme synthesis electronics 26 which, in general, identify phoneme parameters as a function of input code from buffer 24, process such parameters, and feed an output through a d/a converter 30 and an amplifier/filter 32 to a speaker 34 for generation of audible speech sounds. Phoneme source 22 may comprise any suitable source of sequential phoneme codes, such as an operator console or text-to-speech translator. Buffer 24 may comprise any suitable serial data buffer or random access memory with serial address control for storing the phoneme codes and for feeding the codes in preselected sequence to synthesis electronics 26. Synthesis electronics 26 includes a microprocessor 27 coupled to a suitable scratchpad RAM 29 and to a ROM 31 in which is stored all operating programming, as well as the various matrices and tables to be discussed. In a presently preferred working embodiment of the invention hereinafter disclosed in detail, phoneme synthesis electronics 26 is embodied in a suitably programmed digital computer, specifically a 6511/EAB microprocessor 27. Software for programming such computer in executable assembly code is included herewith as a microfiche appendix (frames 3–16). Such code will be referenced by line number in the following discussion. The microfiche appendix also includes the multiplication tables (frames 17–21), input excitation waveform table (frame 22), the differential noise table (frame 23) and the phoneme parameter table (frame 24). The phonemes listed in the last frame of the appendix are based upon the World English Spelling System.

Figure 2:
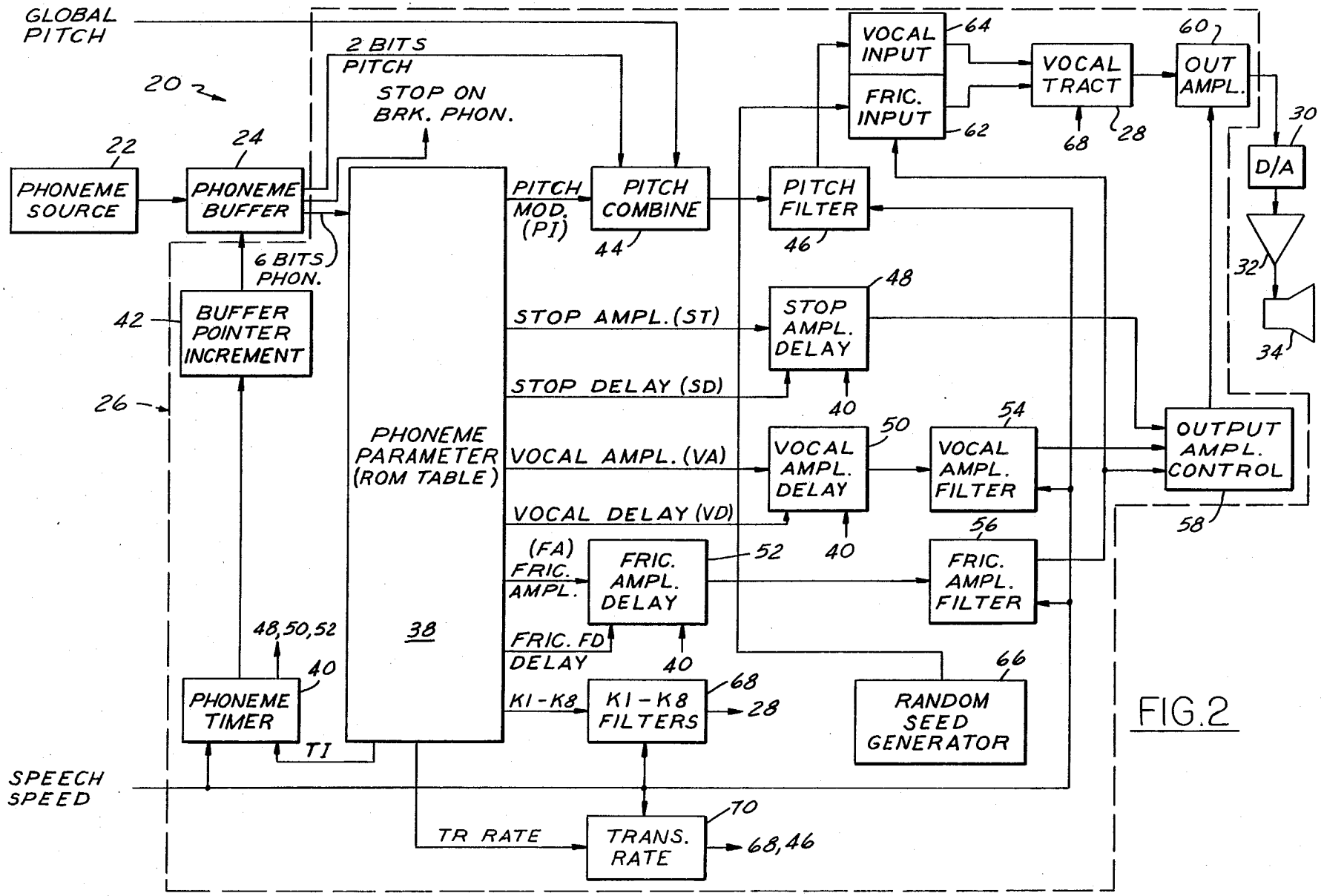
FIG. 2 is a detailed functional diagram of the apparatus illustrated in FIG. 1.

FIG. 2 is an expanded functional block diagram of synthesizer 20 which features more detailed illustration of phoneme synthesis electronics 26. The output of phoneme buffer 24 in the preferred working embodiment of the invention herein described comprises an eight-bit code which includes six phoneme selection bits and two pitch control bits. The six phoneme selection bits are fed to a phoneme parameter matrix 38 such as a ROM table in which phoneme parameters are prestored by six-bit selection code. For each six-bit phoneme selection code, matrix 38 provides a phoneme duration parameter TI to a phoneme timer 40. Phoneme timer 40 also receives an input indicative of basic speech speed from an operator or other suitable source (not shown). In general, phoneme timer 40 controls timing of the various phoneme parameter delays to be described, and upon termination of a particular phoneme, increments a buffer pointer 42 for input of the next phoneme-select code in buffer 24. Matrix 38 also provides a pitch modification parameter PI for each phoneme, which is combined at 44 with the two-bit pitch code from buffer 24 and with a global pitch input from an operator or other suitable source (not shown). A combined pitch signal is fed to a pitch filter module 46. In general, the two-bit pitch command stored in buffer 24 controls the basic pitch contour of the associated phoneme and is selected by the user as a function of stress or inflection to be placed on the phoneme. The pitch modification parameter PI is empirically preselected for each phoneme and generally varies among stressed vowel phonemes, medium vowels, unstressed vowels, liquid phonemes, nasal phonemes, vocal stops and fricative stops.

A stop delay 48 receives a stop amplitude parameter ST and a stop delay parameter SD for each phoneme, as well as a input from phoneme timer 40. In general, the stop amplitude parameter ST is chosen empirically to simulate constriction in a human vocal tract during articulation of the particular phonetic sound, and the stop delay parameter SD is chosen empirically to coordinate timing of both vocal and fricative delays. A vocal amplitude delay 50 receives a vocal amplitude parameter VA and a vocal delay parameter VD from matrix 38, again as a function of selected phoneme, and an input from timer 40. The vocal amplitude parameter VA is empirically selected and generally controls amplitude of the vocal component of each phoneme. The vocal delay parameter VD controls transition timing of the phoneme vocal component and is empirically selected to match change in vocal amplitude to phoneme articulation.

A fricative amplitude delay 52 receives a fricative amplitude parameter FA and a fricative delay parameter FD from matrix 38, as well as an input from phoneme timer 40. Fricative amplitude parameter FA is chosen empirically to control amplitude of the fricative phoneme component, and the fricative delay parameter FD is chosen empirically so that the onset of the fricative energy matches phonetic articulation. A vocal amplitude filter 54 and a fricative amplitude filter 56 receive speech rate inputs, and also receive inputs from vocal amplitude delay 50 and fricative amplitude delay 52 respectively. In general, the function of filters 54,56 is to smooth transition of vocal and fricative components between successive phonemes. The outputs of stop amplitude delay 48 and of filters 54,56 are fed to an output amplitude control 58 which controls an output amplifier 60 coupled to an eighth order real time lattice filter vocal tract 28. The output of fricative amplitude filter 56 is also fed to a fricative input 62 to vocal tract 28. Fricative input 62 also receives input from a random number or seed generator 66. A vocal input 64 to vocal tract 28 receives input from pitch filter 46.

A series of filters 68 receive corresponding input parameters K1 through K8 from phoneme parameter matrix 38. Filters 68 again function to smooth parameter transition between successive phonemes. The outputs of filters 68 are fed to vocal tract 28 and determine the poles of the vocal tract lattice filter network. In general, the parameters K1 through K8 relate to area ratios at sequential positions along a human vocal tract during utterance or articulation of the phoneme in question. It is to be noted that the K parameters vary as a function of changes in vocal tract area each phoneme may be selected empirically. However, in the working embodiment of the invention herein disclosed, the parameters K1 through K8 were selected using as a first approximation the corresponding parameters provided by a Texas Instrument LPC (linear predictive coding) speech analyzer. This first approximation was then tailored or scaled to values between $+1$ and $-1$ at increments. That is, the possible value for each K parameter are the $\frac{1}{8}$ incremented values between $-1$ and $+1$. The importance of such $\frac{1}{8}$-increment scaling selection will become apparent when discussing operation of vocal tract 28 in connection with FIG. 9. Each K parameter is additionally tailored as compared with the LPC-generated value to closely approximate the total vocal tract area rather than individual K parameters. The latter tailoring has been found to yield more realistic speech sounds.

Matrix 38 also provides a transition rate parameter TR to a transition rate module 70. In general, transition rate parameter TR is empirically selected to match articulation rate for each particular phoneme and rate of transition between phonemes. The last frame of the microfiche appendix to this application comprises a complete table of sixty-three selectable phonemes in the working embodiment of the invention, together with corresponding parameters K1–K8, VA, VD, FA, FD, ST, SD, TR, TI and PI in hexadecimal.

Figure 3:
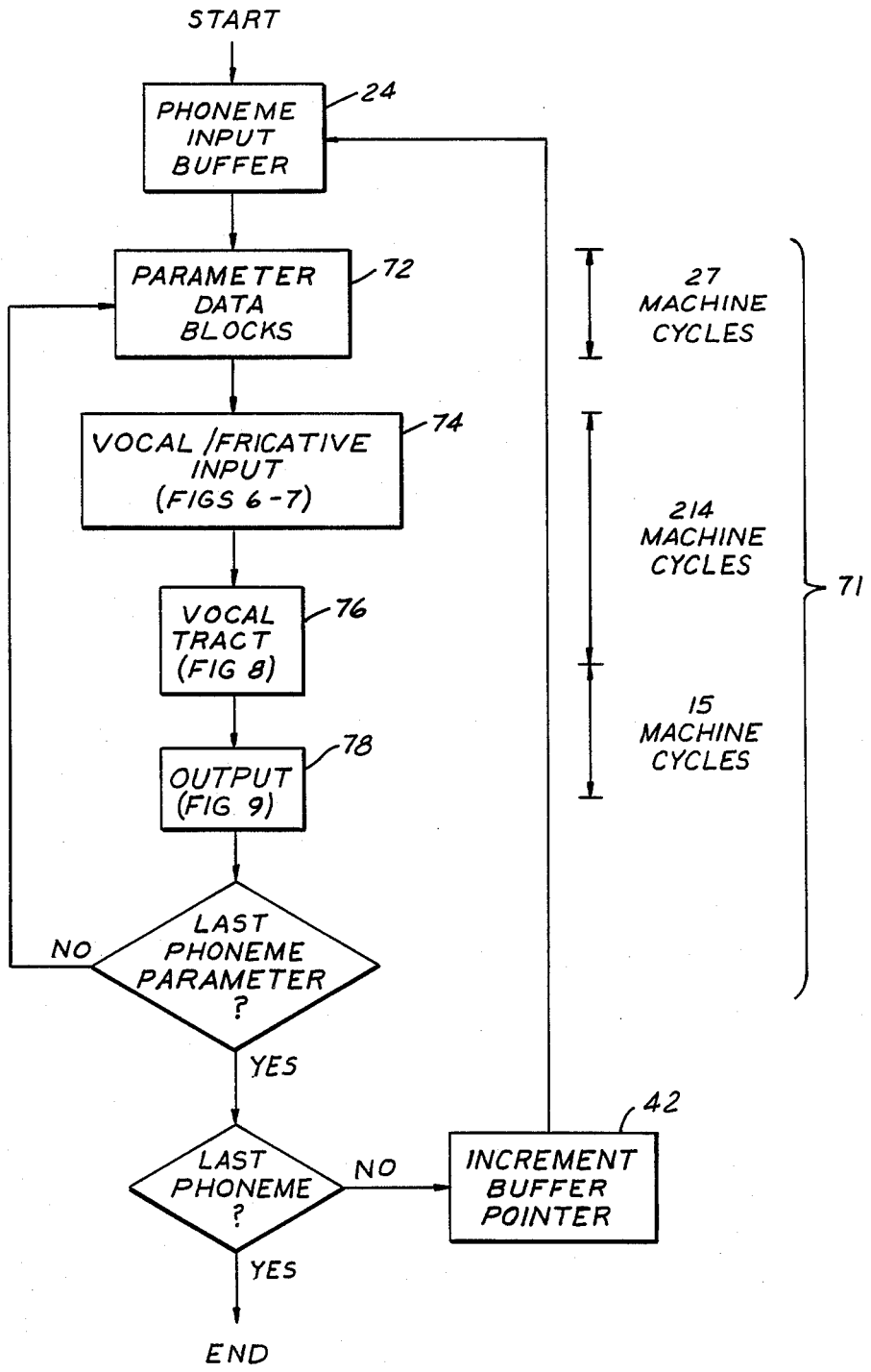
FIG. 3 is a general flow chart illustrating operation of the apparatus of FIGS. 1 and 2.

As indicated above, phoneme parameter electronics 26 (FIGS. 1 and 2) and vocal tract 28, in the preferred embodiment of the invention, comprise a programmed microcomputer 36. FIG. 3 is a general flow chart of operation of microcomputer 36. Prior to initiation of operation, the series of phonemes to be articulated is stored by sequential phoneme code in buffer 24. The first phoneme code is obtained, and corresponding phoneme parameters are identified in matrix 38. Operation then proceeds in a series of time frames 71 of equal duration in which operations are performed in a given phoneme parameter (72), and operation then jumps to execution of the vocal/fricative input routine 74, the vocal tract routine 76 and the output routine 78 in sequence. This cycle is repeated a number of times, specifically thirty-one times, until all parameters for the particular phoneme have been employed. The next phoneme code is then extracted from buffer 24 using incremental pointer 42. The cycles are repeated until the last phoneme is synthesized, at which point operation terminates.

It will thus be appreciated, in accordance with an important feature of the invention, that the input, vocal tract and output routines 74–78 are automatically repeated at precisely timed equal intervals. In the working embodiment of the invention, each frame is of 3.875 ms time duration, corresponding to a total of 256 machine cycles at a 2.048 MHz operating frequency. Synthesizer output is thus refreshed at precisely 8 KHz, yielding high quality synthetic speech. Input and vocal tract routines 74,76 (FIGS. 6–8 and lines 15–38 of the appendix) require precisely 214 machine cycles, and output routine 78 (FIG. 9 and lines 92–95 and 101) requires precisely 15 machine cycles. Twenty-seven machine cycles are thus available for each parameter operation routine 72.

FIGS. 4A–4H collectively comprise a detailed flow chart of operation of micro-computer 36 through sequential frames 71. In general, operation flows from top to bottom of each of FIGS. 4A–4H in sequence, with each figure being divided horizontally or laterally by phantom lines into segments corresponding to twenty-seven machine cycles. At the end of each such segment, operation automatically jumps to the input subroutine (FIG. 6), and then to the vocal tract (FIG. 8) and output (FIG. 9) subroutines, following which operation returns to the point of interruption and continues through the next parameter segment. Each frame 71 (FIG. 3) thus consists of a 27-cycle segment of FIGS. 4A–4H plus the routines of FIGS. 6–9. For purposes of reference, each segment of FIGS. 4A–4H includes a descriptive legend to facilitate reference to FIG. 2, and a parenthetic reference to corresponding lines of code in the appendix.

Referring in greater detail to FIGS. 4A–4H, the SPEECH SPEED CONTROL routine (FIG. 4A) adds the speed parameter to an accumulator whose overflow determines when the filter and timing parameters are to be updated. Each time the sum exceeds or equals \$80, the remaining thirty segments are executed. If the sum is less than \$80, then the remaining segments are bypassed and a do-nothing wait routine is executed. The speed parameter, SPPAR, is repetitively added to the SP accumulator while overflows are concurrently generated. Timing parameter TI is also incremented once on overflow. Thus, the maximum speech speed occurs at $80, while the minimum speed is at $01. Each execution of all parameter segments constitutes a frame which will be thirty-one output samples in duration at the fastest speech speed with the SP parameter at $80. The PHONEME BUFFER CONTROL routine checks to see if the phoneme time TI has reached or exceeded the prescribed phoneme duration as defined by the phoneme's TI parameter TIPAR. If this time interval has elapsed, the next phoneme in the input buffer is then fetched. The new phoneme is then checked to see if it is a BREAK (BRK) phoneme, which is a special command. If it is not a BRK phoneme, then execution continues into the next routine. If the new phoneme is a BRK phoneme, a different path into the next segment is taken. If the phoneme timer has not expired, a third route is taken to the next routine.

The RANDOM SEED GENERATOR, GLOBAL PITCH and GLOBAL RATE CONTROL routine (FIGS. 4A–4B) has three entry points. The first entry point is entered with the condition that a break phoneme was selected. As previously indicated, there are sixty-three selectable phonemes, the sixty-fourth code available (six bit selection) indicates the BRK phoneme. Programming then reads the two pitch control bits for special commands, of which four are possible. A value of "1" terminates operation. A value of "2" or "3" indicates that the next byte in the phoneme buffer is to be stored as a new global pitch parameter GLPI or speech speed parameter SPPAR respectively. If SPPAR is set to $00, a default value SPDEF is then loaded into SPPAR from memory and execution is passed to the next routine segment. The second entry point is made with a new phoneme. Its inflection (or pitch) bits are then shifted to the right six times into bits "0" and "1". The phoneme timer TI is reset to zero in order to begin timing of the new phoneme. The third entry point is executed if the phoneme timer has not expired. It seeds the random number generator in the vocal tract input routine with a new random seed value.

The FRICATIVE DELAY and PITCH COMBINE routine or segment (FIG. 4B) also has three entry points. The first entry point is taken when the global speed or pitch has been set. A new phoneme is then needed for input to the synthesizer and it is fetched at this time. This is accomplished by going back to NEW PHONEME input in FIG. 4A. The second entry point occurs when a new phoneme has just been initiated. The input PIDELAY to the pitch filter is computed by adding the output of the pitch table look-up from the phoneme inflection input TABLEIN to the global pitch GLPI and the phoneme pitch modifier from the phoneme parameter tables PHPI. The output is then inverted so that higher pitch values will produce higher pitch frequencies. The third entry point occurs when a new phoneme has not just been selected The phoneme timer TI is then compared with the fricative delay parameter FD from the phoneme parameter tables. If TI equals FD, the fricative amplitude FA of the current phoneme is applied to the input to the fricative amplitude filter FRAMPIN.

The VOCAL DELAY routine (FIG. 4B) compares the phoneme timer TI with the vocal delay parameter VD from the phoneme parameter tables. If TI equals VD, the vocal amplitude VA of the current phoneme is applied to the input to the vocal amplitude filter AMPIN.

Figure 5:
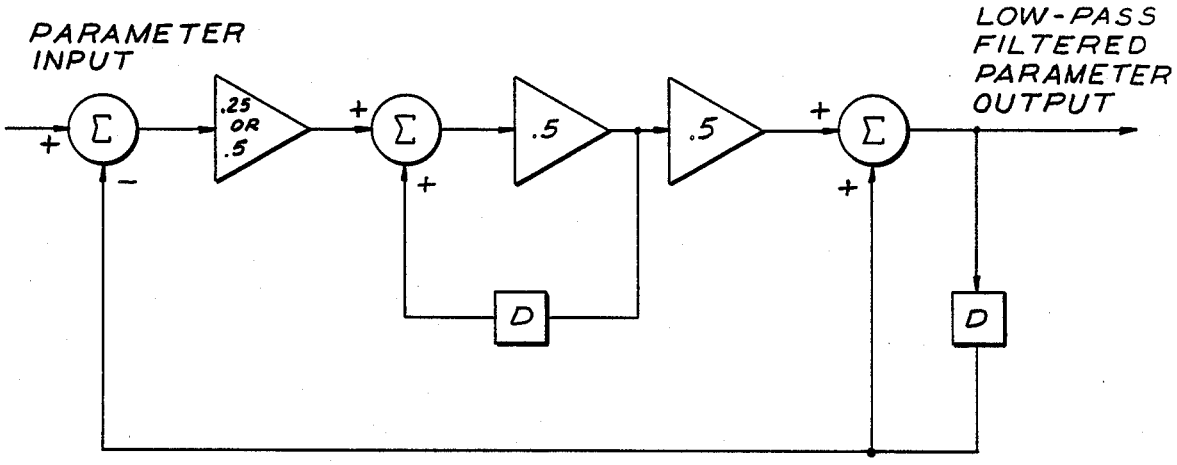
FIG. 5 is a functional block diagram which illustrates operation of the filter stages of FIG. 2.

The STOP DELAY routine (FIG. 4C) compares the phoneme timer TI with the stop delay parameter SD from the phoneme parameter tables. If TI equals SD, the stop amplitude ST of the current phoneme is applied to the delayed stop parameter STDELY for later application to the output amplitude control The VOCAL AMPLITUDE FILTER PARTS 1 and 2 (FIG. 4C) combine to form one lowpass filter stage which filters the delayed vocal amplitude parameter AMPIN. The filter response is overdamped second order. The FRICATIVE AMPLITUDE FILTER PARTS 1 and 2 combine to form an identical lowpass filter which filters the delayed fricative amplitude parameter FRAMPIN. The vocal and fricative amplitude filters are illustrated functionally in FIG. 5 with the first multiplier value of 0.5. This filter is the digital equivalent of a biquad or biquadratic second order filter. In FIG. 5 the "D" blocks represent one filter sample delay.

Figure 9:
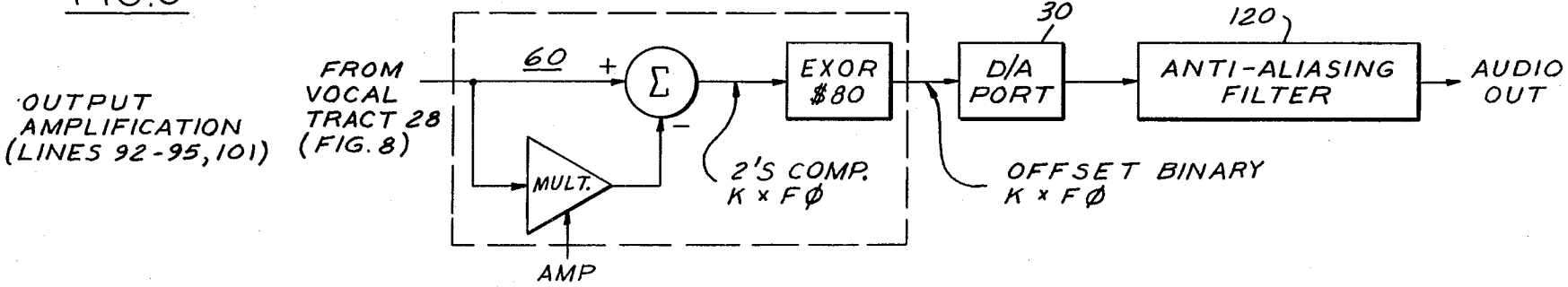
FIG. 9 is a functional block diagram which illustrates the output amplification routine of FIGS. 2, 3 and 8.

The FRICATIVE INPUT PARAMETER routine (FIG. 4D) first determines if the filtered fricative amplitude component FRAMP of the phoneme is zero. If it is zero, then a binary mask called FRICMASK, which is a vocal tract input parameter, is set to $00 which blocks all fricative input into the vocal tract. Also, the fricative pointer's most significant byte, the page pointer, points to a page of zeros so that no noise will be added to the vocal input pulse. If FRAMP is not equal to zero, then FRICMASK is set to $FF which allows the full output of the noise signal to be applied to the input of the vocal tract routine. Also, the fricative pointer's most significant byte, the page pointer, points to a page of differential noise allowing this noise signal to be applied to the vocal tract input. The filtered vocal amplitude VOAMP is then compared against zero. If it is not zero, fricative mask FRICMASK is set to $00. The OUTPUT AMPLITUDE CONTROL routine (FIG. 4D) computes the output amplitude parameter AMP which is applied to the output amplitude routine at the output of the vocal tract (FIGS. 2 and 9). AMP is computed by adding VOAMP with FRAMP. If this sum equals or exceeds the delayed output stop amplitude STDELY, AMP is set to the value of STDELY. If this sum is less than STDELY, its value is unaffected.

Figure 4A:
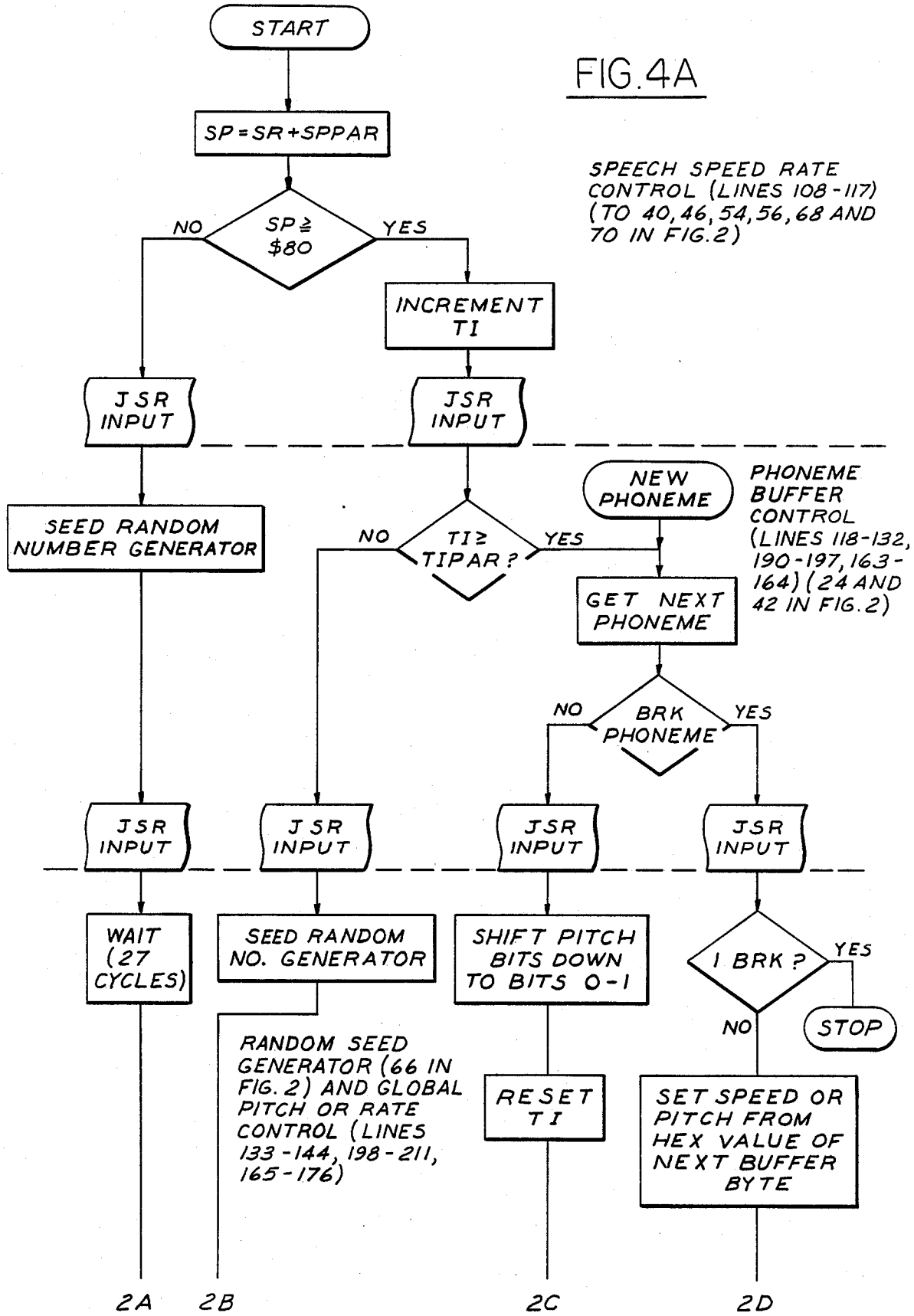
FIGS. 4A–4H together comprise a detailed flow chart illustrating operation of the embodiment of FIGS. 1 and 2.
Figure 4B:
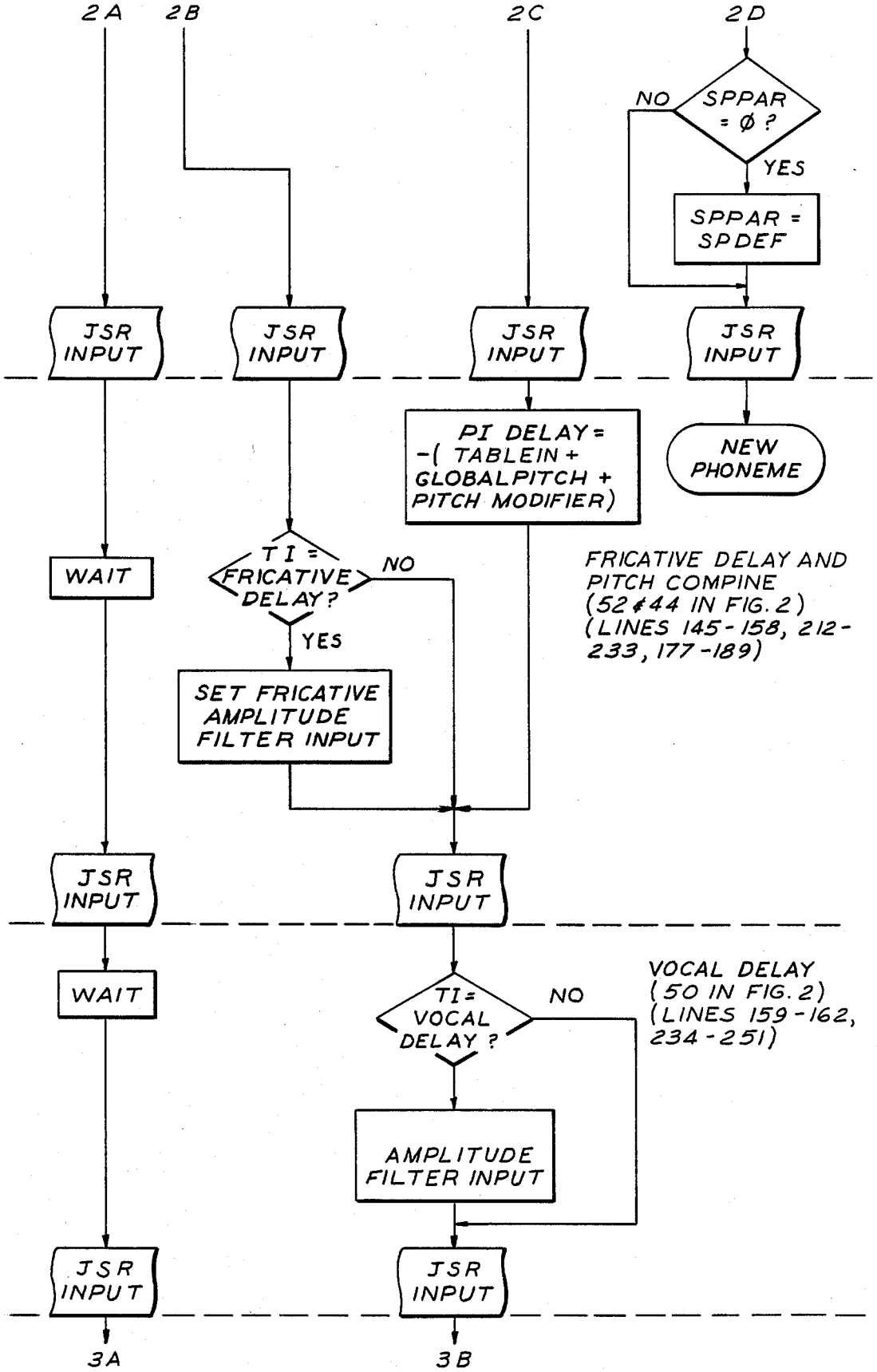
Figure 4C:
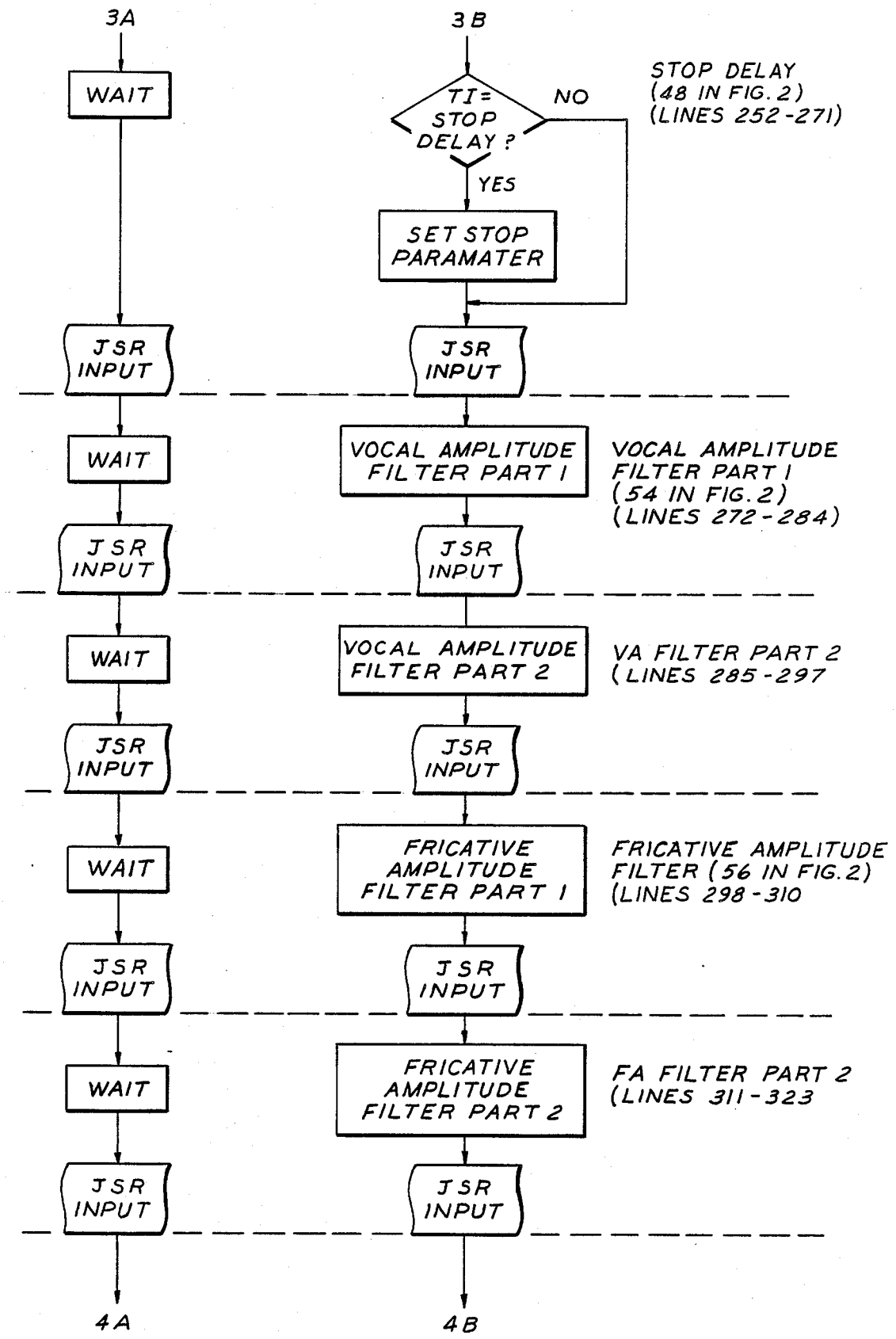

The TRANSITION RATE routine (FIGS. 4D–4E) operates in the same manner as the SPEECH SPEED CONTROL (FIG. 4A) discussed hereinabove. The transition rate parameter TRPAR from the phoneme parameter tables is added to its accumulator TR. Upon overflow, the PITCH FILTERS and the K-FILTERS are executed (FIGS. 4E–4H). If no overflow occurs, the program executes an eighteen-segment wait whose execution time equals that of the bypassed filter stages. The PITCH FILTER PARTS 1 and 2 combine to form one lowpass filter stage which filters the vocal pitch parameter PIDELAY from the PITCH COMBINE routine (FIG. 4B). Filtered vocal amplitude VOAMP is compared against zero. If it equals zero, then PITCHPAR is set to zero. This occurs only on a purely fricative phoneme. Otherwise PITCHPAR, the output of the pitch filter, is unaffected. Filtering operation is illustrated functionally in FIG. 5, having a first multiplier value of 0.25. This multiplier value makes the filter rise time slower than that of the amplitude filters.

The K8 through K1 FILTER routines (FIGS. 4E–4H) have identical operation to that of the pitch filter. These filters are split into two segments like the amplitude filters previously described. They have the same slow response as the pitch filter. Their inputs K8TABLE through K1TABLE come from the phoneme parameter table. Their outputs K8F, K8B through K1F, K1B are applied to the vocal tract routine. The KnF and KnB outputs are scaled by a factor of 1/16 in comparison to the parameter values stored in the parameter tables. These numerous outputs then form the low nibble in their respective multiply table pointers for subsequent multiplication by signal values in the vocal tract. The START OF SPEECH SPEED CONTROL is merely a jump to the start of the SPEECH SPEED CONTROL routine (FIG. 4A).

The VOCAL TRACT ROUTINE (74, 76, 78 in FIG. 3) is made up of three parts. These three components work in concert to produce all the components of the acoustic output signal which drives the digital to analog converter to produce the analog output waveform. The VOCAL/FRICATIVE INPUT ROUTINE produces three classes of excitation for vocal tract 28. The first type of excitation is voiced such as the vowels. In this instance, only VOCAL INPUT is utilized. The second type of excitation is a noise or fricative source, such as that found in voiceless fricatives such as "s" and "p". In this case, only FRICATIVE INPUT block 62 is utilized. The third class of excitation is the voiced fricative which utilizes both the FRICATIVE and VOCAL INPUT blocks. Phonemes such as "v" and "z" are typical examples. The entire input routine elsewhere described resides in lines 15–38 of the assembly listing (appendix). Any JSR (jump to subroutine) step in the executable code jumps to this input routine. VOCAL TRACT, elsewhere described, is in lines 39–91, 96–100 and 102 of the appendix. It produces all the transfer functions characteristic of the human vocal tract in response to its eight K-parameters. OUTPUT AMPLIFICATION 60 controls the magnitude of the output signal sent to the digital to analog (D/A) port. Its gain is variable in steps of ⅛ from zero to 1.875. Its assembly lines are 92–95 and 101. Line 101 resets the processor's Y-register to zero so as not to adversely affect subsequent indirect addressing in the program.

Figure 4D:
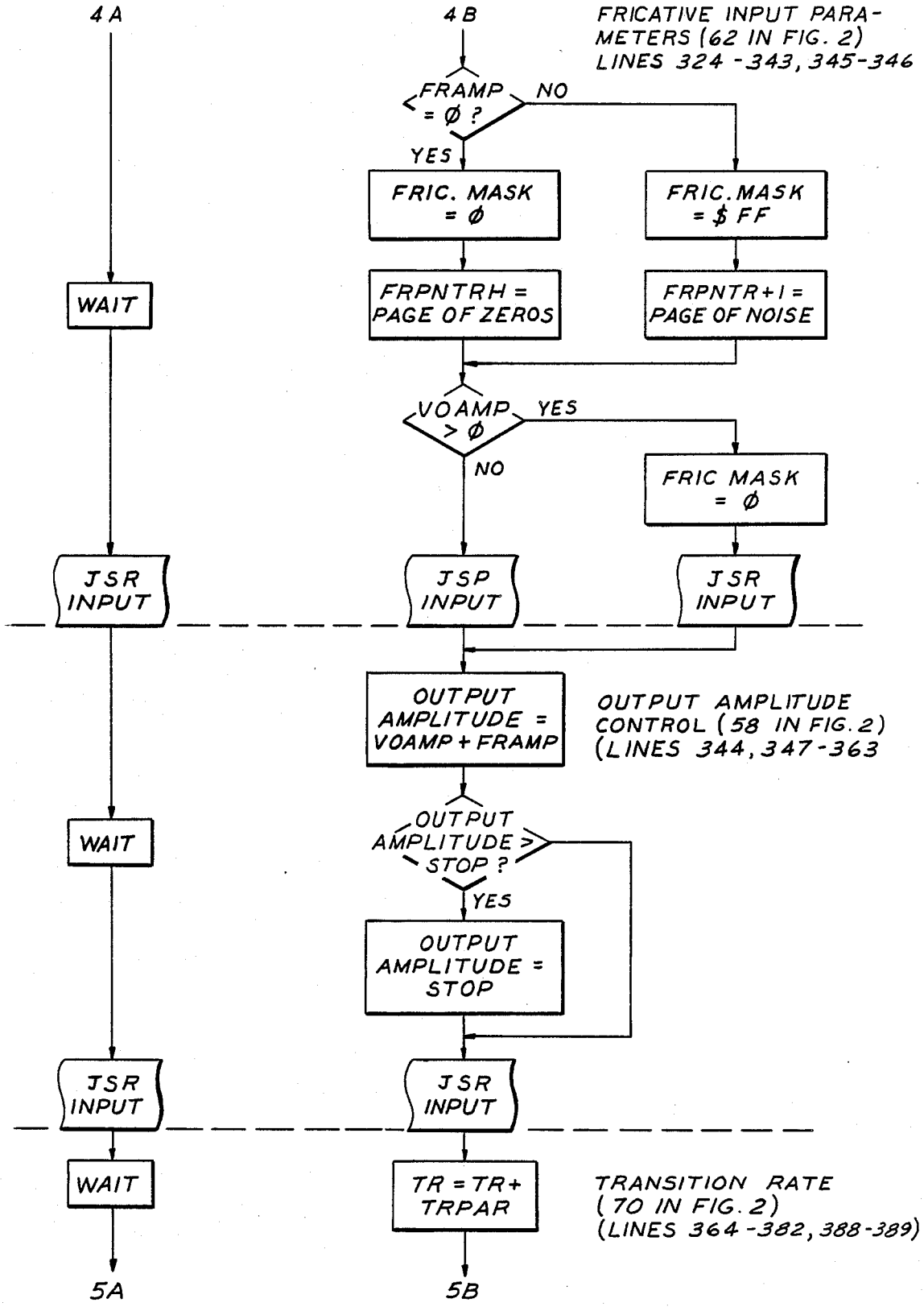
Figure 4E:
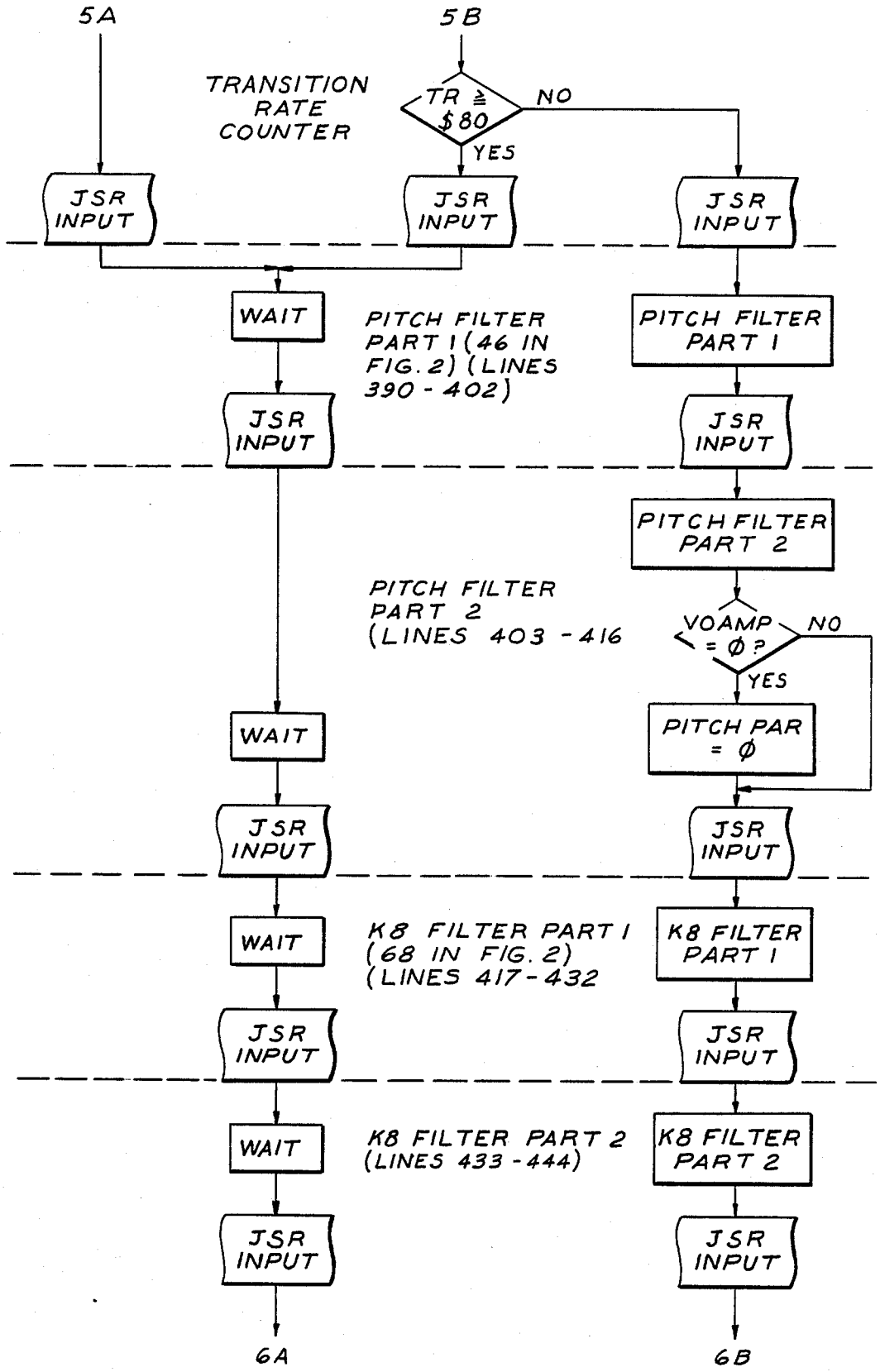
Figure 4F:
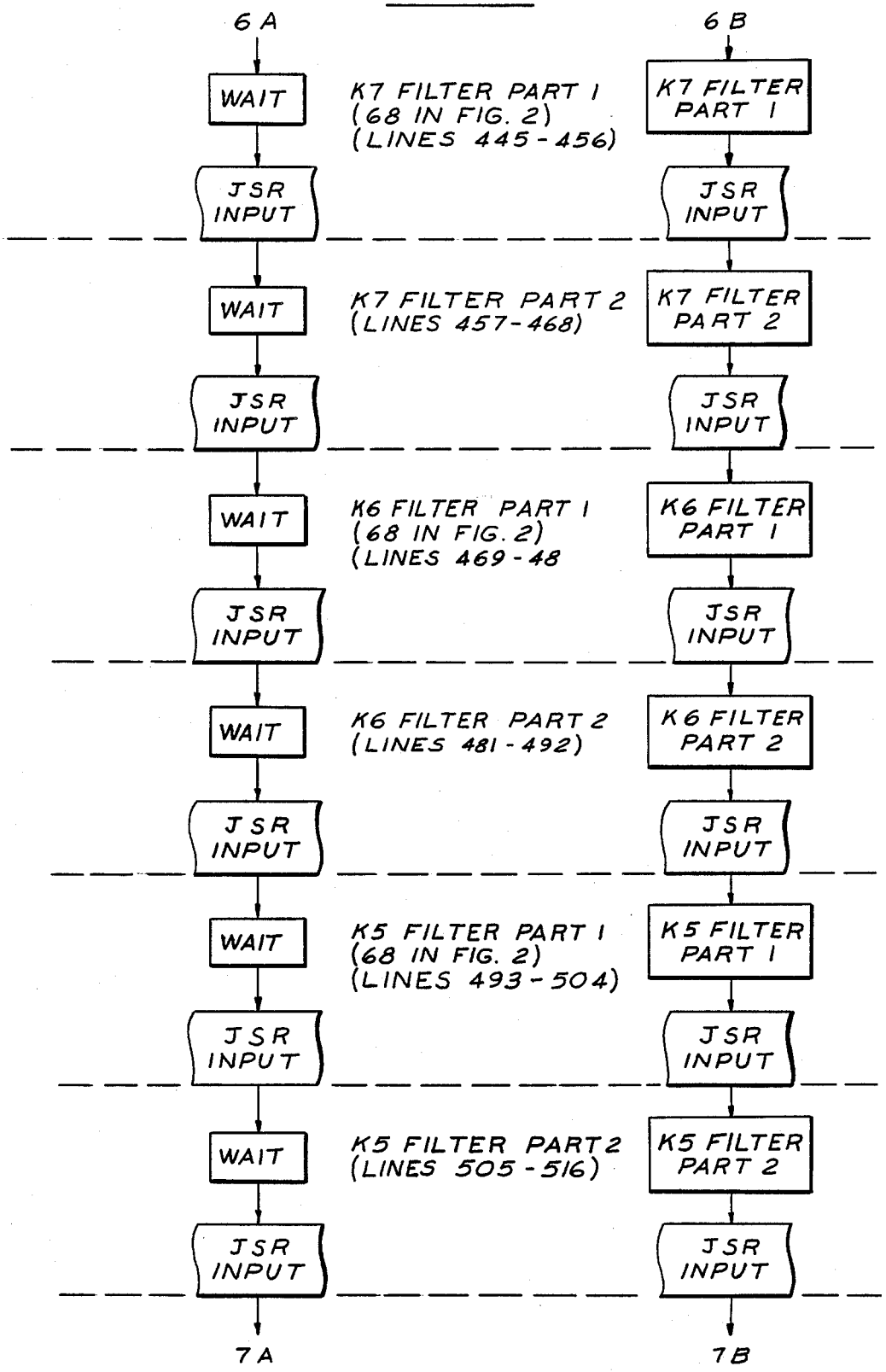
Figure 4G:
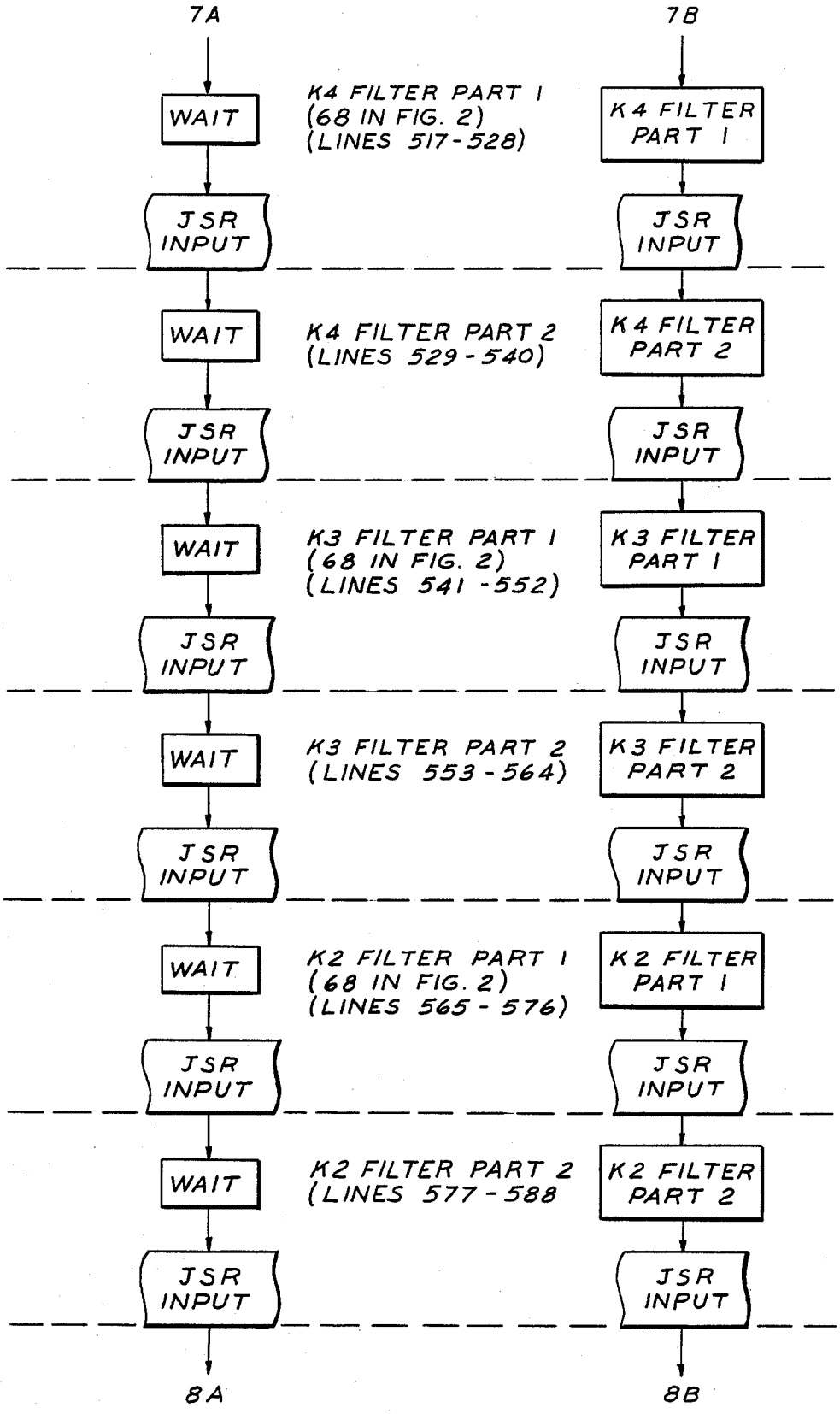
Figure 4H:
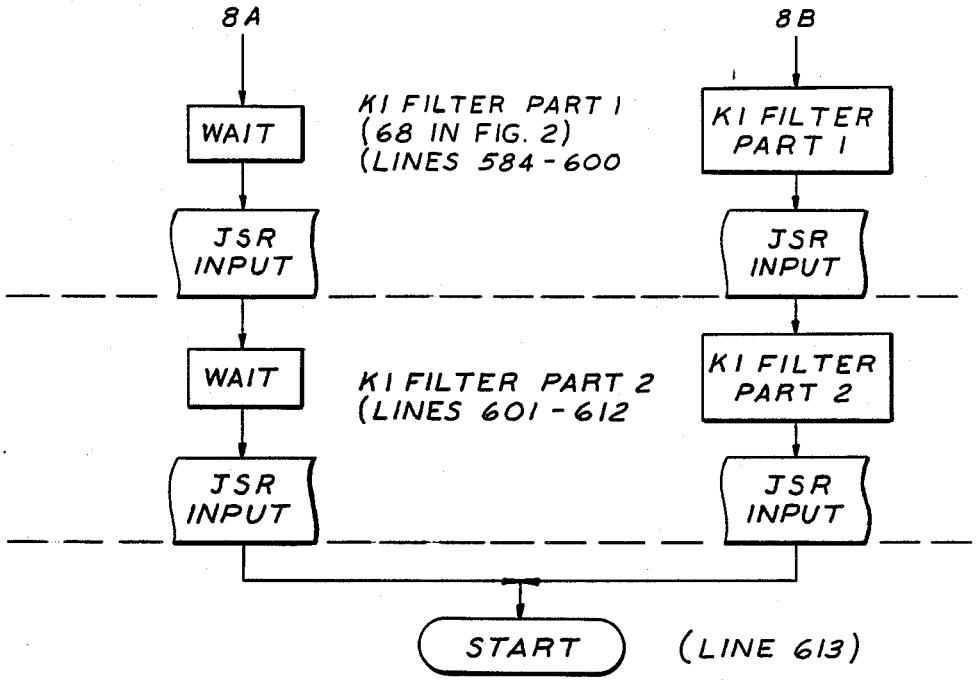
Figure 6:
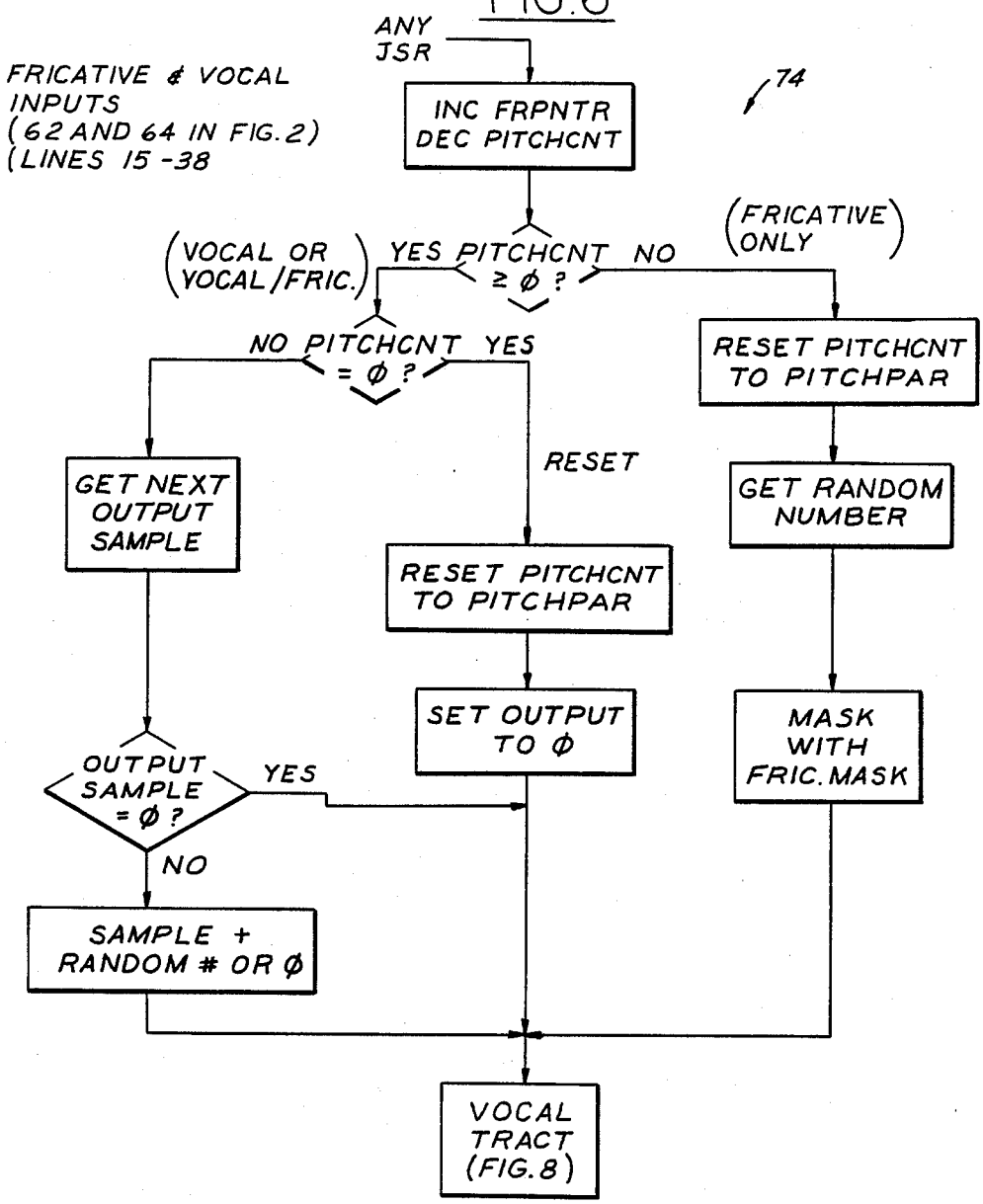
FIG. 6 is a detailed flow chart of the vocal/fricative input routine illustrated functionally in FIG. 2 and generally in FIG. 3.
Figure 7:
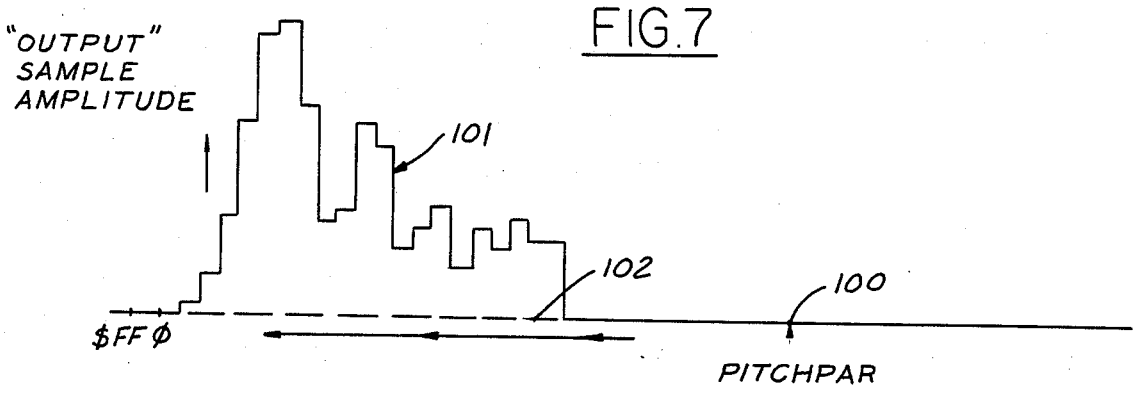
FIG. 7 is a graphic illustration useful in discussing operation of the flow chart of FIG. 6.

FIG. 6 is a flow chart of the vocal and fricative input routine 74 (FIG. 3 and lines 15–38 of the appendix). Input variables to input routine 74 include the fricative pointer variable FRPNTR which is a random number from random seed generator 66 (FIGS. 2 and 4D), the pitch parameter variable PITCHPAR from pitch filter 46 (FIGS. 2 and 4E) which controls pitch, and the variable FRICMASK from fricative amplitude filter 56 (FIGS. 2 and 4D). As previously noted in connection with FIG. 4E, the variable PITCHPAR is equal to zero for fricative phonemes, and is non-zero for voice fricatives (and vocals). This number is an integer modulus which is closest to the sample frequency (8 KHz) divided by the desired fundamental pitch frequency. The variable FRICMASK is zero for voice phonemes, and $FF for fricatives or voice fricatives. Input routine 74 also employs an output sample look-up table in which is stored the output sample waveform 101 illustrated in FIG. 7. The abscissa in FIG. 7 is in incremental units of time referenced to a pitch count variable PITCHCNT which is employed internally of input routine 74. The variable PITCHCNT is employed for distinguishing phonemes which possess a vocal component, and for implementing such vocal component. The ordinate of FIG. 7 from PITCHCNT increments between zero and $1C (hexadecimal), comprises a digitized partially integrated chirp pulse, with the chirp function being equal to $\sin(kt^2)$. This waveform possesses a spectrum which closely matches that of human speech. At values of PITCHCNT greater than $14, the corresponding output amplitude is equal to zero. The look-up table in which FIG. 7 is stored in the working embodiment of the invention is at frame twenty-two in the appendix.

Upon each entry to the input subroutine, the input variable FRPNTR is incremented and variable PITCHCNT, which is initially set at zero, is decremented from its previous value. The variable PITCHCNT is then tested for being greater than or equal to zero. If the variable PITCHCNT is less than zero—i.e., is equal to $FF (FIG. 7)—a fricative-only phoneme is indicated. However, if the variable PITCHCNT is greater than or equal to zero, the phoneme is either vocal or voice fricative. Assuming that a fricative-only phoneme is indicated, the variable PITCHCNT is set equal to PITCHPAR, which is equal to zero for a fricative-only phoneme. Next, a random number is obtained using the variable FRPNTR to access a prestored look-up table (frame twenty-three of the appendix). This table contains data indicative of differential noise, which has been found to yield the proper fricative spectrum employing the same values of K1–K8 as for vocal or voice fricative phonemes. The random number obtained from the differential noise look-up table is then masked with the variable FRICMASK, which is a fricative bit mask from the fricative amplitude filter. The result is then passed unaltered to the vocal tract routine. Note that, with the variable PITCHCNT set equal to zero, operation will again flow through to the fricative-only branch of FIG. 6 on the next passage thereto because the variable PITCHCNT is initially decremented upon entry to the input routine.

On the other hand, if upon entry to the input routine the value of the variable PITCHCNT is such that the decremented variable is greater than or equal to zero, indicating a vocal or voice fricative phoneme, the variable PITCHCNT is next tested for equality with zero. If the variable PITCHCNT is equal to zero, the variable is reset equal to PITCHPAR. The variable OUTPUT is set equal to zero and operation transfers to the vocal tract routine of FIG. 8. On the other hand, if the variable PITCHCNT is not equal to zero, a value for the variable OUTPUT is obtained from the sample look-up table in which the waveform of FIG. 7 is stored, using the variable PITCHCNT as a table address. Initially, for a vocal or vocal/fricative phoneme, the variable PITCHCNT is set equal to PITCHPAR. In FIG. 7, it is assumed that the variable PITCHPAR initially sets the variable PITCHCNT at the location 100 in which the OUTPUT amplitude is equal to zero. The next comparison is thus true, the variable OUTPUT is set equal to the next sample in the input excitation look-up table, and operation is transferred to the vocal tract routine of FIG. 8. However, on each successive passage through the input routine, the variable PITCHCNT is decremented until the point 102 (FIG. 7) is reached wherein the OUTPUT sample amplitude for that value of the variable PITCHCNT is non-zero. The digital sample amplitude is then added to a random number in the case of a voiced fricative, and operation is transferred to the vocal tract subroutine of FIG. 8. Thus, the value of the variable PITCHPAR set in the INPUT routine (FIG. No. 6) determines the fundamental pitch of a voiced or voiced fricative phoneme. A phoneme is entirely fricative for PITCHPAR equal to zero, vocal/fricative for PITCHPAR greater than zero with a fricative at mask of $FF, or entirely vocal with FRICMASK equal to zero. It is to be noted from FIG. 7 and from the preceding discussion relative thereto that the present invention differs markedly from the prior art in its ability to generate vocal and fricative sounds simultaneously.

Figure 8:
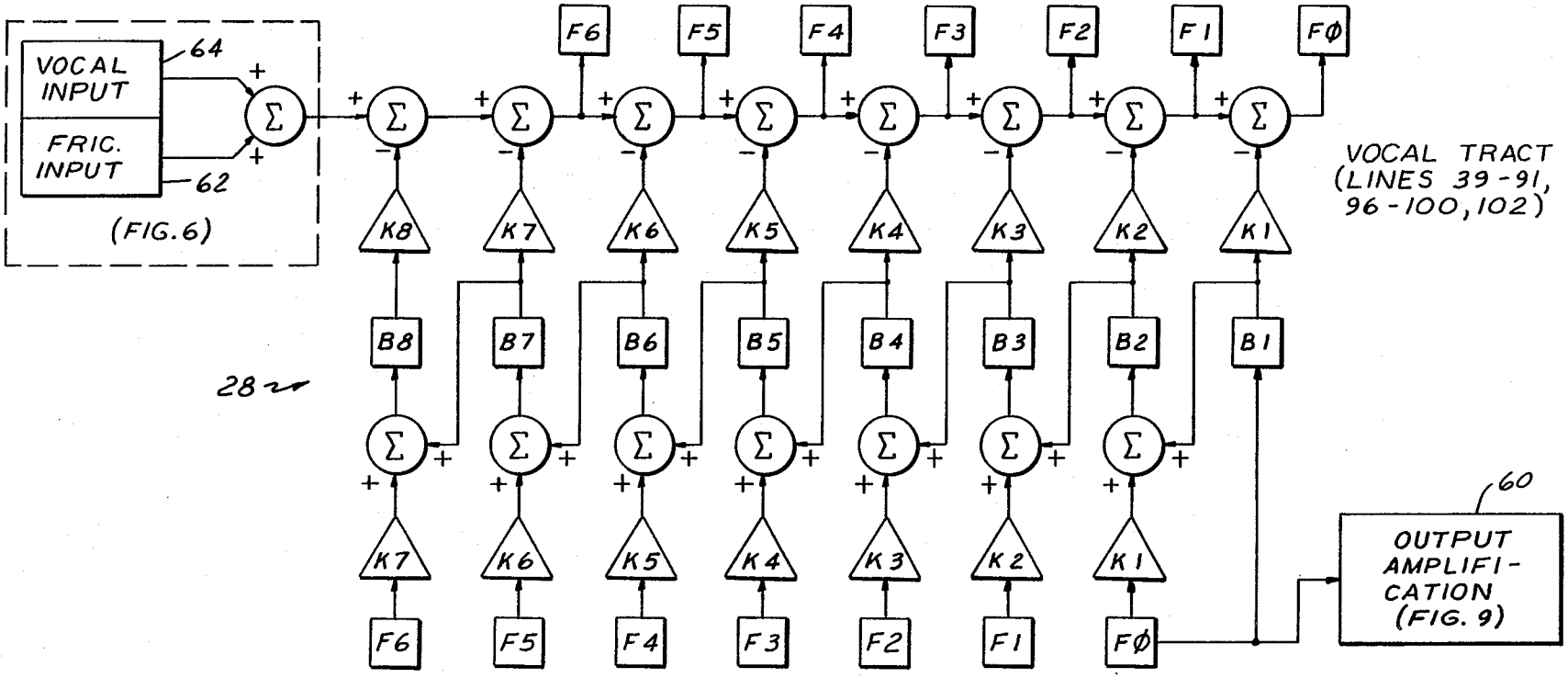
FIG. 8 is a functional block diagram which illustrates operation of the vocal tract routine of FIGS. 2 and FIG. 3.

Referring to FIG. 8 (and to lines 39–91, 96–100 and 102 of the appendix), vocal tract 28 is illustrated as comprising an eighth order time domain lattice filter network having the variables F0–F6 and B1–B8, and having poles determined by the phoneme parameters K1 through K8. In accordance with an important feature of the preferred working embodiment of the invention, the F and B variables are computed upon each passage of operation through the vocal tract routine in the following order: F6, F5, F4, F3, F2, F1, B8, B7, B6, B5, B4, B3, B2, B1, F0. That is, the variable F6 at sample interval k is first computed (lines 44–48) as being equal to $OUTPUT_k - K8*B8_{k-1} - K7*B7_{k-1}$. The variable F5 is then computed (lines 49–51) as being equal to $F_6k - K6*B6_{k-1}$, etc. Variable $FO_k$, which is the output to the output amplification routine 60 (FIG. 9), is computed (lines 88–91) as equal to $F1_k - K1*B1_{k-1}$. The variables $B1_k$ through $B8_k$ are then computed in sequence (lines 64–87, 96–100) preparatory to the next sampling interval k+1.

Thus, the various F variables are computed as a function of the B variables during the preceding sampling interval. Such operation has been found to provide a lattice filter output which employs a greatly reduced number of computation steps, but with no decrease in quality, as compared with the art. It is also to be noted that the vocal tract 28 of the present invention does not include any amplitude control per se, which is contrary to the teachings of applicable prior art. Rather, amplitude control is conducted at the output from the vocal tract, which obtains an enhanced signal-to-noise ratio. Furthermore, use of K parameters between −1 and +1, and at discrete = intervals permits multiplication by shifting of data bits rather than mathematical operations typical of the art, and thus not only speeds operation but also minimizes introduction of "mathematical noise". Indeed, it has been found that the vocal tract of the present invention obtains greater fidelity and accuracy using only eight-bit mathematics than do twelve-bit vocal tracts of the prior art.

The output amplification routine 60 is illustrated functionally in FIG. 9, which finds correspondence at lines 92–95 and 101 of the microfiche appendix. The digital output variable FO(?) from the vocal tract is initially scaled at a summing junction by a factor which depends upon the output variable AMP from output amplitude and control routine 58 (FIGS. 2 and 4D). The result, which is in twos-complement binary, is then exclusive-ORed with $80 to convert to offset binary, which provides an output to the d/a converter 30. Most preferably, the output of d/a converter is fed through an anti-aliasing filter 120 prior to amplification at 32 (FIGS. 1 and 2).

Figure 10:
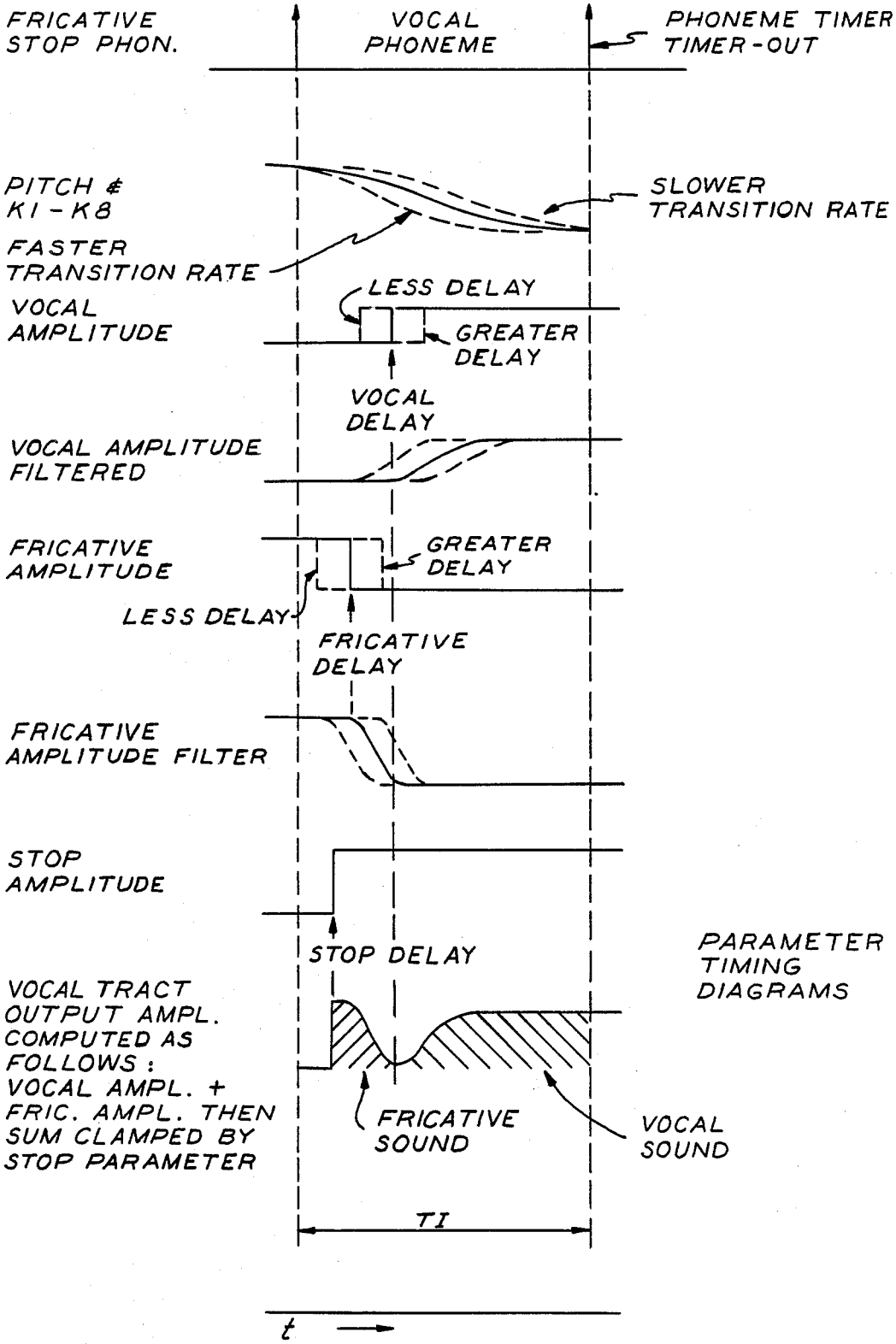
FIGS. 10 and 11 are graphic illustrations which are useful in discussing interrelationship of phoneme parameters in operation of the invention.

FIG. 10 illustrates effect of the various matrix parameters during synthesis of an exemplary vocal phoneme following a fricative stop phoneme. Output pitch and effect of vocal tract pole parameters K1 through K8 vary smoothly during the vocal phoneme, having a phoneme duration time TI, with transition being a function of transition rate parameter TR. Likewise, the output of vocal amplitude delay 50 switches from zero (during the preceding fricative phoneme) to the appropriate level VA at a time from onset of the vocal phoneme which varies as a function of vocal delay parameter VD. However, the output of vocal amplitude filter 54 increases slowly from the switching point of the vocal amplitude module output. Likewise, the fricative amplitude parameter FA switches from its initial value during the preceding fricative stop phoneme, to a zero value during the vocal phoneme, at a time from onset of the vocal phoneme which varies as a function of fricative delay FD. However, the output of fricative amplitude filter 56 decays only gradually. The stop delay parameter SD switches following onset of the vocal phoneme. The vocal tract output, illustrated in the bottom graph, comprises the sum of the fricative sound beginning at the stop-delay parameter time and declining to zero, followed by the vocal sound which increases from zero starting from the vocal delay time. The sequence of a fricative stop phoneme followed by a vocal phoneme illustrated in FIG. 10 could correspond to the word "tea" for example, for which the corresponding phoneme codes in the last frame of the appendix are $2D and $09.

Figure 11:
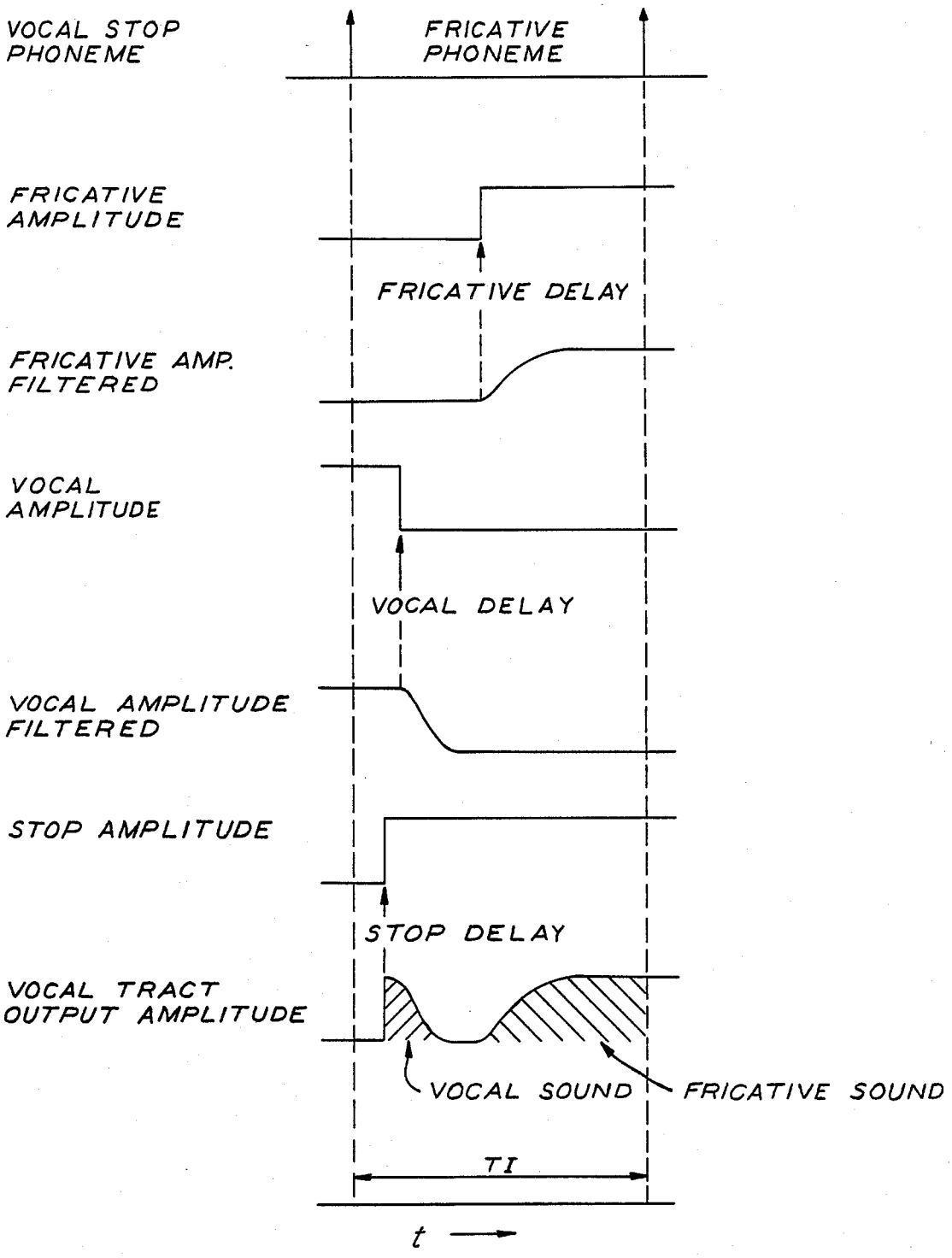

FIG. 11 illustrates a sequence which consists of a vocal stop phoneme followed by a fricative phoneme, such as in the word "absent", for example. The corresponding phoneme codes in the last frame of the appendix are $07 and $2A. The graphic illustrations in FIG. 11 otherwise correspond to those hereinabove discussed in connection with FIG. 10.

Although the presently preferred working embodiment of the invention hereinabove disclosed is embodied and implemented substantially entirely in a suitably programmed general purpose microcomputer, it will be appreciated that a portion or all of the disclosed structure and method could as readily be implemented in discrete but interconnected and controlled electronics modules.

The invention claimed is:

1. A phonetically driven speech synthesizer comprising:

vocal tract means;

means for providing a plurality of parameter signals indicative of frequency, amplidtude and timing characteristics of a selected phoneme to be synthesized, means responsive to said vocal tract means for generating audible sounds, and control means including first means responsive to each of said parameter signals in turn for generating corresponding control signals, second means for intermittently operating said vocal tract means responsive to said control signals, and third means for controlling operation of said first and second means in alternating sequence at intervals of predetermined fixed time duration wherein said vocal tract means includes lattice filter means responsive to said control signals for determining amplitude and frequency characteristics of phonemes to be synthesized.

2. The speech synthesizer set forth in claim 1 wherein said first means includes means for individually storing each of said control signals, and means responsive to said third means for obtaining a said parameter signal, generating a corresponding updated control signal during successive operating cycles of said first means, and storing said updated control signal in said storage means.

3. The speech synthesizer set forth in claim 2 wherein said parameter signal-obtaining means includes means for obtaining said parameter signals and generating corresponding updated control signals in a predetermined sequence in successive operating cycles of said first means.

4. The speech synthesizer set forth in claim 3 further comprising matrix means having prestored therein a multiplicity of parameter signals individually associated with and selectable as a function of phonemes to be synthesized, and means for receiving coded digital data indicative of a selected speech phoneme to be synthesized, said first means being responsive to said coded digital data for reading from said matrix means parameter signals associated with said selected speech phoneme.

5. The speech synthesizer set forth in claim 4 further comprising means for establishing basic phoneme pitch, and wherein said means for receiving coded digital data includes means for receiving data indicative of changes in said basic phoneme pitch and means responsive to said change-indicative data for modifying said basic phoneme pitch.

6. The speech synthesizer set forth in claim 4 further comprising means for establishing basic speech speed rate, and wherein said means for receiving coded digital data includes means for receiving data indicative of changes in said basic speech speed rate and means responsive to said change-indicative data for modifying said basic speech speed rate.

7. The speech synthesizer set forth in claim 3 wherein said vocal tract means comprises a vocal tract including said lattice filter means responsive to first ones of said control signals for controlling frequency characteristics of said filter means, input means responsive to second ones of said control signals for controlling timing characteristics of input signals to said vocal tract, and output means coupled to said vocal tract and responsive to third ones of said control signals for controlling amplitude of vocal tract output signals fed to said sound-generating means.

8. The speech synthesizer set forth in claim 7 wherein said lattice filter includes means for forming a cascade lattice filter having first and second sets of interdependent variables, means for storing said variables, and means operative during each said operating cycle of said vocal tract means for obtaining said first set of variables as a function of the said second set of variables obtained during the preceding operating cycle.

9. The speech synthesizer set forth in claim 7 further comprising a source of vocal sound including storage means having data prestored therein indicative of amplitude of a preselected vocal sound, and wherein said input means comprises means for sequentially addressing storage locations of said vocal sound storage means during corresponding sequential operating cycles of said vocal tract means.

10. The speech synthesizer set forth in claim 9 wherein said predetermined vocal sound comprises a partially integrated chirp pulse having a contour illustrated to scale in FIG. 7 of the drawings.

11. The speech synthesizer set forth in claim 9 further comprising a source of fricative sound including storage means having data prestored therein indicative of differential noise amplitude, and wherein said input means comprises means for randomly addressing storage locations of said fricative sound storage means during each said operating cycle of said vocal tract means.

12. The speech synthesizer set forth in claim 11 wherein said input means further comprises means for simultaneously applying both vocal and fricative sound signals to said vocal tract.

13. A phonetically driven speech synthesizer comprising matrix means having prestored therein a multiplicity of parameters individually associated with and selectable as a function of phonemes to be synthesized, said parameters being a function of desired frequency, amplitude and timing characteristics of individual phonemes, means for receiving coded digital data indicative of a selected speech phoneme to be synthesized and for reading a plurality of said parameters from said matrix means associated with said selected phoneme, vocal tract means responsive to a plurality of control signals for generating vocal and fricative sounds, and control means including first means responsive to said digital data for obtaining a corresponding plurality of parameters from said matrix means, second means responsive to each said parameter for generating corresponding control signals in a predetermined sequence of individual successive operations, and third means for intermittently and alternately operating said second means and said vocal tract means in successive operating cycles of predetermined fixed time duration.

14. The speech synthesizer set forth in claim 13 wherein said control means further includes means for establishing basic speech speed rate and operating said third means as a function of said basic speech speed rate, means for establishing a basic phoneme pitch and for operating said vocal tract means as a function of said basic phoneme pitch, and means responsive to said coded digital data for selectively varying said basic speech speed rate and said basic phoneme pitch.

15. The speech synthesizer set forth in claim 13 wherein said third means comprises means responsive to each said parameter in a predetermined parameter sequence in successive ones of said operating cycles.

16. The speech synthesizer set forth in claim 15 wherein said vocal tract means comprises a vocal tract including said lattice filter means responsive to first ones of said control signals for controlling frequency characteristics of said filter means, input means responsive to second ones of said control signals for controlling timing characteristics of input signals to said vocal tract, and output means coupled to said vocal tract and responsive to third ones of said control signals for controlling amplitude of vocal tract output signals fed to said sound-generating means.

17. The speech synthesizer set forth in claim 16 wherein said lattice filter includes means for forming a cascade lattice filter having first and second sets of interdependent variables, means for storing said variables, and means operative during each said operating cycle of said vocal tract means for obtaining said first set of variables as a function of the said second set of variables obtained during the preceding operating cycle.

18. The speech synthesizer set forth in claim 15 further comprising a source of fricative sound including storage means having data prestored therein indicative of differential noise amplitude, and wherein said input means comprises means for randomly addressing storage locations of said fricative sound storage means during each said operating cycle of said vocal tract means.

19. The speech synthesizer set forth in claim 18 further comprising a source of vocal sound including storage means having data prestored therein indicative of amplitude of a preselected vocal sound, and wherein said input means comprises means for sequentially addressing storage locations of said vocal sound storage means during corresponding sequential operating cycles of said vocal tract means.

20. The speech synthesizer set forth in claim 19 wherein said input means further comprises means for simultaneously applying both vocal and fricative sound signals to said vocal tract.

21. A method of synthesizing speech phonemes, the method utilizing a lattice filter vocal tract means responsive to a multiplicity of individual control signals for controlling output characteristics of synthesized sounds, the method comprises the steps of:

(a) generating a series of parameter signals indicative of amplitude, frequency and timing control parameters of each phoneme to be synthesized, (b) generating corresponding control signals to said vocal tract means as a function of at least one of said parameter signals, (c) generating synthetic sound at said vocal tract means responsive to said control signals, and (d) alternately repeating said steps (c) and (b) in a series of operating cycles of predetermined fixed time duration.

22. The method set forth in claim 21 wherein said step (a) includes the step of storing said parameter signals in a matrix addressable as a function of a digital phoneme code, and wherein said step (b) comprises the steps of receiving coded digital data indicative of a phoneme to be synthesized and obtaining corresponding parameters from said matrix in a predetermined sequence in successive ones of said operating cycles.

23. The method set forth in claim 22 wherein said step (c) comprises the step of generating vocal sounds at a global pitch modified by selected ones of said parameters, and wherein said method comprises the additional steps of receiving second coded digital data indicative of desired changes in said global pitch, and modifying said global pitch as a function of said second coded digital data.

24. The method set forth in claim 23 wherein said step (d) includes the step of controlling said predetermined fixed time duration as a function of a speed control signal, and wherein said method comprises the additional steps of receiving third coded digital data indicative of desired changes in said speech speed and modifying said speech speed control signal as a function of said third coded digital data.

25. The method set forth in claim 24 comprising the step of receiving all of said coded digital data as serially sequential data bytes, and distinguishing between phoneme indicative digital data and change-indicative digital data as a function of data code.

26. A microprocessor-based method of phonetic speed synthesis as a function of predetermined sound control parameters corresponding to each of a series predetermined program routines including first routines and second routines, said method comprising the steps of:

(a) storing said predetermined parameters in a memory device such that such parameters are readable as a function of a phonetic sound to be synthesized, (b) generating control data as a function of each parameter for controlling amplitude, frequency and timing of a corresponding elected phoneme, (c) continuously cycling through said first and second routines in a series of predetermined operating cycles of fixed time duration, each said operating cycle including one of said first routines selected in a predetermined sequence in successive ones of said operating cycles and all of said second routines.

* * * * *